US009434569B2

(12) United States Patent
Mindler et al.

(10) Patent No.: US 9,434,569 B2
(45) Date of Patent: Sep. 6, 2016

(54) OFFSET PRINT STACKING TRAY WITH WASTE AREA

(71) Applicant: KODAK ALARIS INC., Rochester, NY (US)

(72) Inventors: Robert Fredric Mindler, Rochester, NY (US); Alex David Horvath, Rochester, NY (US)

(73) Assignee: Kodak Alaris Inc., Rochester, NY (US)

( * ) Notice: Subject to any disclaimer, the term of this patent is extended or adjusted under 35 U.S.C. 154(b) by 0 days.

(21) Appl. No.: 14/462,031

(22) Filed: Aug. 18, 2014

(65) Prior Publication Data

US 2015/0048567 A1 Feb. 19, 2015

Related U.S. Application Data

(60) Provisional application No. 61/867,336, filed on Aug. 19, 2013.

(51) Int. Cl.

| | |
|---|---|
| ***B65H 39/10*** | (2006.01) |
| ***B65H 37/00*** | (2006.01) |
| ***B65H 31/24*** | (2006.01) |
| ***B65H 31/26*** | (2006.01) |
| ***B65H 31/40*** | (2006.01) |
| ***B65H 31/02*** | (2006.01) |
| ***B41J 13/10*** | (2006.01) |

(52) U.S. Cl.

CPC ..... *B65H 37/00* (2013.01); *B41J 13/106* (2013.01); *B65H 31/02* (2013.01); *B65H 31/24* (2013.01); *B65H 31/26* (2013.01); *B65H 31/40* (2013.01); *B65H 2301/543* (2013.01); *B65H 2405/1111* (2013.01); *B65H 2405/1115* (2013.01); *B65H 2801/12* (2013.01)

(58) Field of Classification Search

CPC ..... B65H 2405/11152; B65H 2405/1111; B65H 2405/1115; B65H 37/00; B65H 31/24; B65H 31/40

See application file for complete search history.

(56) References Cited

U.S. PATENT DOCUMENTS

| | | | | |
|---|---|---|---|---|
| 3,160,413 | A * | 12/1964 | Faeber | 271/188 |
| 4,364,553 | A * | 12/1982 | Wilson | 271/219 |
| 7,673,873 | B2 | 3/2010 | Mindler et al. | |
| 2005/0275157 | A1* | 12/2005 | Mindler et al. | 271/207 |
| 2009/0212483 | A1* | 8/2009 | Maruyama | B65H 3/54 271/111 |
| 2010/0129130 | A1 | 5/2010 | Ward | |
| 2012/0193868 | A1* | 8/2012 | Bluethgen | B65H 29/246 271/220 |

OTHER PUBLICATIONS

International Search Report and Written Opinion dated Apr. 22, 2015 in corresponding PCT application No. PCT/US2014/051489.

* cited by examiner

*Primary Examiner* — Howard Sanders
(74) *Attorney, Agent, or Firm* — Hogan Lovells US LLP

(57) ABSTRACT

A receiving well for use with a thermal dye sublimation printing apparatus is disclosed. The receiving well is used to receive cut sheets printed using the thermal dye sublimation printing. The receiving well includes two angled surfaces, referred to herein as ramps. The ramps are spaced apart from one another, and a waste area is positioned between the two ramps. The waste area captures the scrap or waste paper that can result from cutting the receiver media after printing. In some embodiments, both ramps slope down to the bottom surface of the receiving well. In other embodiments, one of the ramps is raised off the bottom surface of the receiving well at its lowest point. The waste area may also be offset such that it is closer to one side of the receiving well than the other.

6 Claims, 12 Drawing Sheets

OFFSET PRINT STACKING TRAY WITH WASTE AREA

CROSS-REFERENCE TO RELATED CASES

This application claims the benefit of U.S. Provisional Application Ser. No. 61/867,336, entitled "OFFSET PRINT STACKING TRAY WITH WASTE AREA," filed on Aug. 19, 2013. The aforementioned provisional application is hereby incorporated by reference in their entirety.

FIELD OF THE INVENTION

This invention pertains to an offset print stacking tray with anti stubbing feature and waste area.

BACKGROUND OF THE INVENTION

In thermal dye sublimation printing, it is generally well known to render images by heating and pressing one or more donor materials such as a colorant (e.g., a dye) or other coating against a receiver medium having a colorant receiving layer. The heat is generally supplied by a thermal print head having an array of heating elements. The donor materials are typically provided in sized donor patches on a movable web known as a donor ribbon. The donor patches are organized on the ribbon into donor sets; each set containing all of the donor patches that are to be used to record an image on the receiver web. For full color images, multiple color dye patches can be used, such as yellow, magenta, and cyan donor dye patches. Arrangements of other color patches can be used in like fashion within a donor set. Additionally, each donor set can include an overcoat or sealant layer.

Thermal printers offer a wide range of advantages in photographic printing including the provision of truly continuous tone scale variation and the ability to deposit, as a part of the printing process a protective overcoat layer to protect the images formed thereby from mechanical and environmental damage. Accordingly, many photographic kiosks and home photo printers currently use thermal printing technology.

Some thermal printing systems are adapted to print on individual sheets of receiver media. Thermal printing systems that are used for large volume applications (e.g., photographic kiosks) commonly utilize roll-fed receiver media. The roll size media may have various fixed dimensions. For example, a common roll fed media size is 8.5 inches wide. This type of media is capable of printing 8.5×11 inch images, or any length image dependent on donor patch length, but are restricted to 8.5 inches wide. However, with the addition of a dual center slitter, two 4×6 inch images can be printed side-by-side with a 0.5 inch center waste strip. FIG. 5 shows a receiver tray commonly known in the art and used in current printing systems. This receiver tray receives the entire sheet of printed media, such as 8.5×11 inch, with no cutting into smaller prints, and stacking of the separate prints from multiple sheets of media. There remains a need in the art for a receiver tray with angled surfaces and a waste area, wherein individually cut smaller printed pieces of receiver media are received on the two angled surfaces of the tray and the waste strip of the receiver media is received in the waste area of the tray. There is also a need to automatically collate the images produced into an intended image order so that, instead of two stacks of images, the result of printing is one stack of ordered images.

SUMMARY OF THE INVENTION

The present invention is directed to a receiver tray for a thermal printer. The receiver tray has angled surfaces, a waste area, and is adapted to hold cut sheet media.

In one embodiment, the invention includes a receiver supply tray adapted to receive cut receiver media. The receiver supply tray includes a cut sheet receiving well having at least two side walls. The receiver supply tray also includes a first ramp disposed between the two side walls. The first ramp can be adjacent to one of the side walls. The receiver supply tray further includes a waste area between the first ramp and the non-adjacent side wall. The waste area can be adapted to receive the waste cut receiver media. The first ramp can be adapted to receive the printed cut receiver media. The receiver supply tray can also include a second ramp, and the second ramp can be positioned adjacent to a side wall opposite to the first ramp.

Another embodiment also includes a receiver supply tray adapted to receive cut sheet media. The receiver supply tray includes a cut sheet receiving well having at least a first and a second side wall. The receiver supply tray can also include a first ramp adjacent to a first sidewall adapted to receive a first printed cut receiver media. A second ramp can be included, and can be located adjacent to a second sidewall. The second ramp can be adapted to receive a second printed cut receiver media. The first and second ramps can define a waste area adapted to receive waste cut receiver media. The waste area can be located between the first and second ramps.

It is to be understood that the attached drawings are for purposes of illustrating the concepts of the invention and may not be to scale.

DETAILED DESCRIPTION OF THE INVENTION

The invention is inclusive of combinations of the aspects of the present invention described herein. References to "a particular aspect" and the like refer to features that are present in at least one aspect of the invention. Separate references to "an aspect" or "particular aspects" or the like do not necessarily refer to the same aspect or aspects; however, such aspects are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 1:
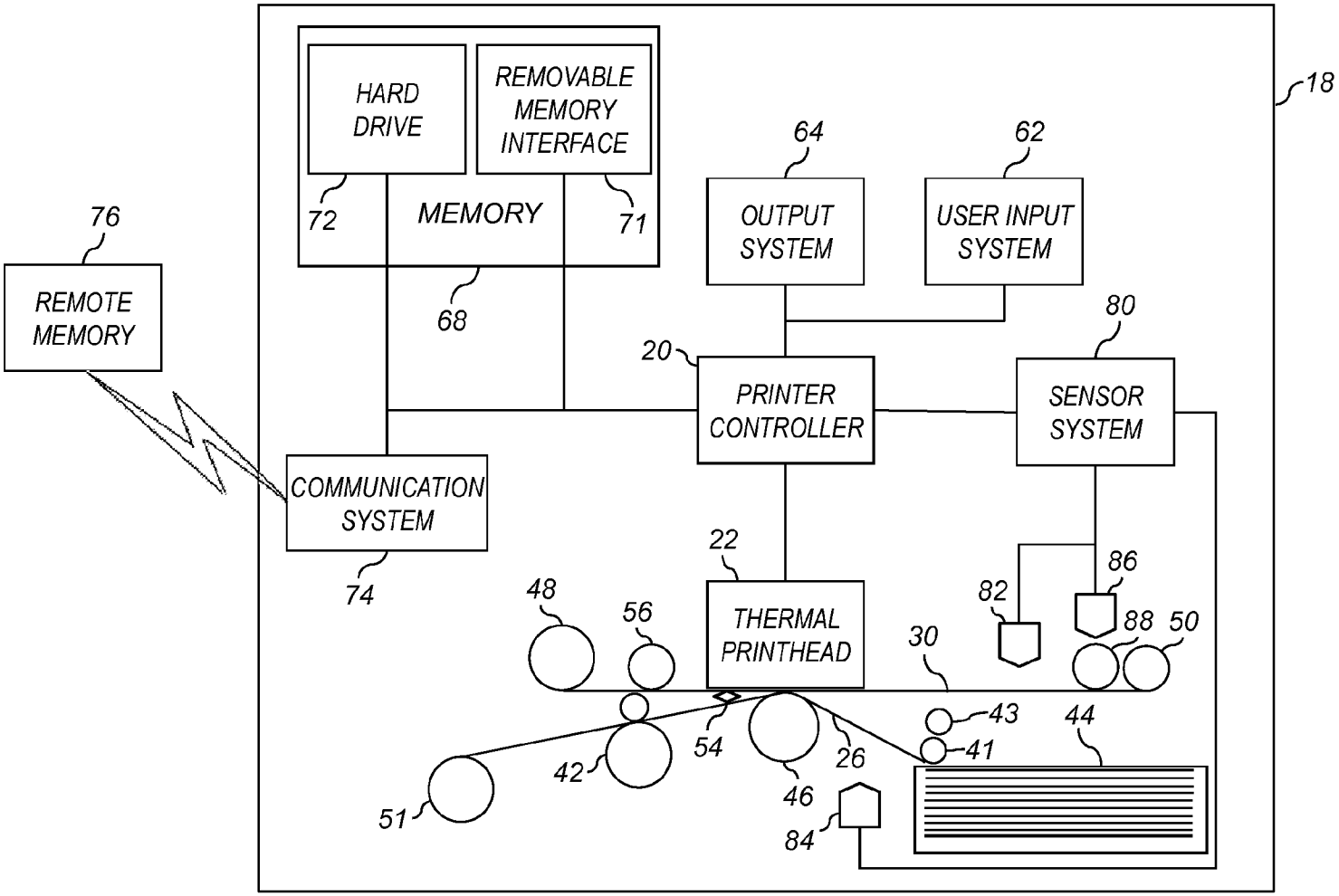
FIG. 1 shows a system diagram for an exemplary thermal printing system that can be used in practicing the present invention.

FIG. 1 shows a system diagram for an exemplary thermal printer 18 that can be used to practice the present invention. As shown in FIG. 1, thermal printer 18 has a printer controller 20 that causes a thermal print head 22 to record images onto receiver media 26 by applying heat and pressure to transfer material from a donor ribbon 30 to receiver media 26. The receiver media 26 includes a dye receiving layer coated on a substrate. As used herein, the term "receiver media" is used synonymously with the terms "thermal imaging receiver" and "thermal media." Similarly, the term "donor ribbon" is used synonymously with the terms "thermal donor" and "donor web."

Printer controller 20 can include, but is not limited to: a programmable digital computer, a programmable microprocessor, a programmable logic controller, a series of electronic circuits, a series of electronic circuits reduced to the form of an integrated circuit, or a series of discrete components. According to an aspect of the invention shown in FIG. 1, printer controller 20 also controls receiver pick rollers 41, a receiver drive roller 42, receiver exit rollers 43, a donor ribbon take-up roll 48, and a donor ribbon supply roll 50; which are each motorized for rotation on command of the printer controller 20 to effect movement of receiver media 26 and donor ribbon 30.

Figure 2:
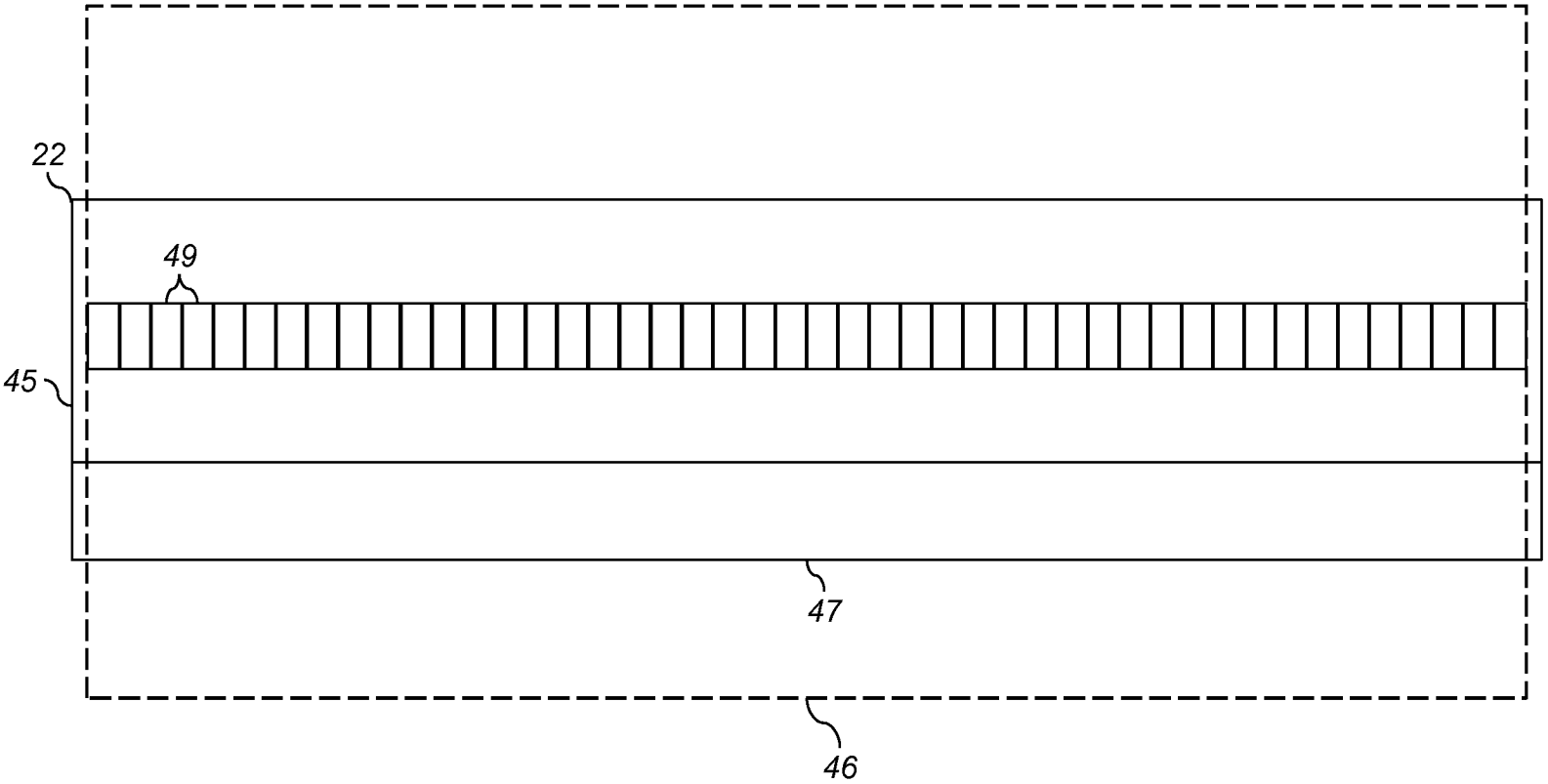
FIG. 2 is a diagram showing a bottom view of a thermal printhead used in FIG. 1.

FIG. 2 shows a bottom view according to one aspect of a typical thermal print head 22 with an array of thermal resistors 49 fabricated in a ceramic substrate 45. A heat sink 47, typically in the form of an aluminum backing plate, is fixed to a side of the ceramic substrate 45. Heat sink 47 rapidly dissipates heat generated by the thermal resistors 49 during printing. As shown in FIG. 2, the thermal resistors 49 are arranged in a linear array extending across the width of platen roller 46 (shown in phantom). Such a linear arrangement of thermal resistors 49 is commonly known as a heat line or print line. However, other non-linear arrangements of thermal resistors 49 can be used in various aspects of the present invention. Further, it will be appreciated that there are a wide variety of other arrangements of thermal resistors 49 and thermal print heads 22 that can be used in conjunction with the present invention.

The thermal resistors 49 are adapted to generate heat in proportion to an amount of electrical energy that passes through thermal resistors 49. During printing, printer controller 20 transmits signals to a circuit board (not shown) to which thermal resistors 49 are connected, causing different amounts of electrical energy to be applied to thermal resistors 49 so as to selectively heat donor ribbon 30 in a manner that is intended to cause donor material to be applied to receiver media 26 in a desired manner.

Figure 3A:
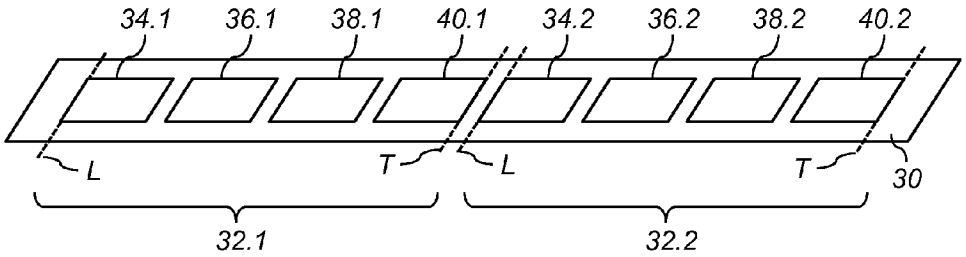
FIG. 3A is a diagram illustrating a donor ribbon having four different donor patches that can be used with the system shown in FIG. 1.
Figure 3B:
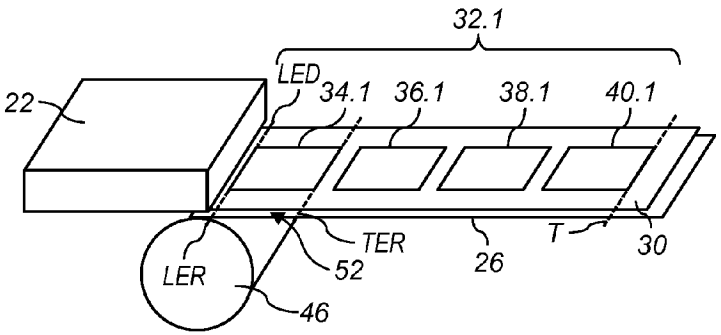
FIGS. 3B-3C illustrate a printing operation using the system shown in FIG. 1.

As is shown in FIG. 3A, donor ribbon 30 comprises a first donor patch set 32.1 having a yellow donor patch 34.1, a magenta donor patch 36.1, a cyan donor patch 38.1 and a clear donor patch 40.1; and a second donor patch set 32.2 having a yellow donor patch 34.2, a magenta donor patch 36.2, a cyan donor patch 38.2 and a clear donor patch 40.2. Each donor patch set 32.1 and 32.2 has a patch set leading edge L and a patch set trailing edge T. In order to provide a full color image with a clear protective coating, the four patches of a donor patch set; are printed, in registration with each other, onto a common image receiving area 52 of receiver media 26 shown in FIG. 3B. The printer controller 20 (FIG. 1) provides variable electrical signals in accordance with input image data to the thermal resistors 49 (FIG. 2) in the thermal print head 22 in order to print an image onto the receiver media 26. Each color is successively printed as the receiver media 26 and the donor ribbon move from right to left as seen by the viewer in FIG. 3B.

During printing, the printer controller 20 raises thermal print head 22 and actuates donor ribbon supply roll 50 (FIG. 1) and donor ribbon take-up roll 48 (FIG. 1) to advance a leading edge L of the first donor patch set 32.1 to the thermal print head 22. In the embodiment illustrated in FIGS. 3A-3C, leading edge L for first donor patch set 32.1 is the leading edge of yellow donor patch 34.1. As will be discussed in greater detail below, the position of this leading edge L can be determined by using a position sensor to detect an appropriate marking indicia on donor ribbon 30 that has a known position relative to the leading edge of yellow donor patch 34.1 or by directly detecting the leading edge of yellow donor patch 34.1.

Printer controller 20 also actuates receiver pick rollers 41 (FIG. 1) to pick cut sheet receiver from receiver supply cassette 44 (FIG. 1) into drive roller 42 (FIG. 1). Printer controller 20 also actuates drive roller 42 (FIG. 1), so that image receiving area 52 of receiver media 26 is positioned with respect to the thermal print head 22. In the embodiment illustrated, image receiving area 52 is defined by a receiving area leading edge LER and a receiving area trailing edge TER on receiver media 26. Donor ribbon 30 and receiver media 26 are positioned so that donor patch leading edge LED of yellow donor patch 34.1 is registered at thermal print head 22 with receiving area leading edge LER of image receiving area 52. Printer controller 20 then causes a motor or other conventional structure (not shown) to lower thermal print head 22 so that a lower surface of donor ribbon 30 engages receiver media 26 which is supported by platen roller 46. This creates a pressure holding donor ribbon 30 against receiver media 26.

Printer controller 20 then actuates receiver drive roller 42 (FIG. 1), donor ribbon take-up roll 48 (FIG. 1), and donor ribbon supply roll 50 (FIG. 1) to move receiver media 26 and donor ribbon 30 together past the thermal print head 22. Concurrently, printer controller 20 selectively operates thermal resistors 49 (FIG. 2) in thermal print head 22 to transfer donor material from yellow donor patch 34.1 to receiver media 26.

Figure 3C:
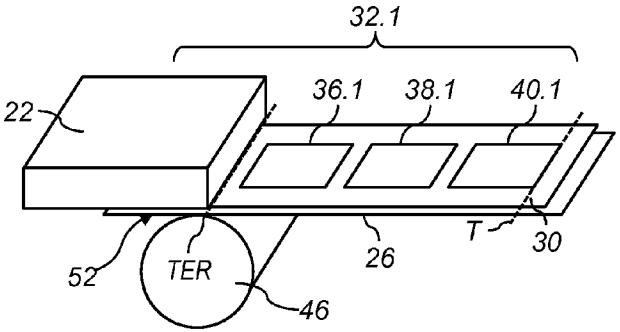

As donor ribbon 30 and receiver media 26 leave the thermal print head 22, a peel member 54 (FIG. 1) separates donor ribbon 30 from receiver media 26. Donor ribbon 30 continues over idler roller 56 (FIG. 1) toward the donor ribbon take-up roll 48. As shown in FIG. 3C, printing continues until the receiving area trailing edge TER of image receiving area 52 of receiver media 26 reaches the printing zone between the thermal print head 22 and the platen roller 46. The printer controller 20 then adjusts the position of donor ribbon 30 and receiver media 26 using a predefined pattern of movements so that a leading edge of each of the next donor patches (i.e., magenta donor patch 36.1) in the first donor patch set 32.1 are brought into alignment with receiving area leading edge LER of image receiving area 52 and the printing process is repeated to transfer further material to the image receiving area 52. This process is repeated for each donor patch thereby forming the complete image.

Returning to a discussion of FIG. 1, the printer controller 20 operates the thermal printer 18 based upon input signals from a user input system 62, an output system 64, a memory 68, a communication system 74, and sensor system 80. The user input system 62 can comprise any form of transducer or other device capable of receiving an input from a user and converting this input into a form that can be used by printer controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such user input systems. An output system 64, such as a display or a speaker, is optionally provided and can be used by printer controller 20 to provide human perceptible signals (e.g., visual or audio signals) for feedback, informational or other purposes.

Data including, but not limited to, control programs, digital images and metadata can also be stored in memory 68. Memory 68 can take many forms and can include without limitation conventional memory devices including solid state, magnetic, optical or other data storage devices. In FIG. 1, memory 68 is shown having a removable memory interface 71 for communicating with removable memory (not shown) such as a magnetic, optical or magnetic disks. The memory 68 is also shown having a hard drive 72 that is fixed with thermal printer 18 and a remote memory 76 that is external to printer controller 20 such as a personal computer, computer network or other imaging system.

As shown in FIG. 1, printer controller 20 interfaces with a communication system 74 for communicating with external devices such as remote memory 76. The communication system 74 can include for example, a wired or wireless network interface that can be used to receive digital image data and other information and instructions from a host computer or network (not shown).

A sensor system 80 includes circuits and systems that are adapted to detect conditions within thermal printer 18 and, optionally, in the environment surrounding thermal printer 18, and to convert this information into a form that can be used by the printer controller 20 in governing printing operations. Sensor system 80 can take a wide variety of forms depending on the type of media therein and the operating environment in which thermal printer 18 is to be used.

As shown in FIG. 1, sensor system 80 includes an optional donor position sensor 82 that is adapted to detect the position of donor ribbon 30, and a receiver position sensor 84 that is adapted to detect a position of the receiver media 26. The printer controller 20 cooperates with donor position sensor 82 to monitor the donor ribbon 30 during movement thereof so that the printer controller 20 can detect one or more conditions on donor ribbon 30 that indicate a leading edge of a donor patch set. In this regard, the donor ribbon 30 can be provided with markings or other optically, magnetically or electronically sensible indicia between each donor patch set (e.g., donor patch set 32.1) or between donor patches (e.g., donor patches 34.1, 36.1, 38.1, and 40.1). Where such markings or indicia are provided, donor position sensor 82 is provided to sense these markings or indicia, and to provide signals to controller 20. The printer controller 20 can use these markings and indicia to determine when the donor ribbon 30 is positioned with the leading edge of the donor patch set at thermal print head 22. In a similar way, printer controller 20 can use signals from receiver position sensor 84 to monitor the position of the receiver media 26 to align receiver media 26 during printing. Receiver position sensor 84 can be adapted to sense markings or other optically, magnetically or electronically sensible indicia between each image receiving area of receiver media 26.

During a full image printing operation, the printer controller 20 causes donor ribbon 30 to be advanced in a predetermined pattern of distances so as to cause a leading edge of each of the donor patches (e.g., donor patches 34.1, 36.1, 38.1, and 40.1) to be properly positioned relative to the image receiving area 52 at the start each printing process. The printer controller 20 can optionally be adapted to achieve such positioning by precise control of the movement of donor ribbon 30 using a stepper type motor for motorizing donor ribbon take-up roll 48 or donor ribbon supply roll 50 or by using a movement sensor 86 that can detect movement of donor ribbon 30. In one example, a follower wheel 88 is provided that engages donor ribbon 30 and moves therewith. Follower wheel 88 can have surface features that are optically, magnetically or electronically sensed by the movement sensor 86.

According to one aspect of the present invention, the follower wheel 88 that has markings thereon indicative of an extent of movement of donor ribbon 30 and the movement sensor 86 includes a light sensor that can sense light reflected by the markings. According to other aspects of the present invention, perforations, cutouts or other routine and detectable indicia can be incorporated onto donor ribbon 30 in a manner that enables the movement sensor 86 to provide an indication of the extent of movement of the donor ribbon 30.

Optionally, donor position sensor 82 can be adapted to sense the color of donor patches on donor ribbon 30 and can provide color signals to controller 20. In this case, the printer controller 20 can be programmed or otherwise adapted to detect a color that is known to be found in the first donor patch in a donor patch set (e.g., yellow donor patch 34.1 in donor patch set 32.1). When the color is detected, the printer controller 20 can determine that the donor ribbon 30 is positioned proximate to the start of the donor patch set.

Figure 4:
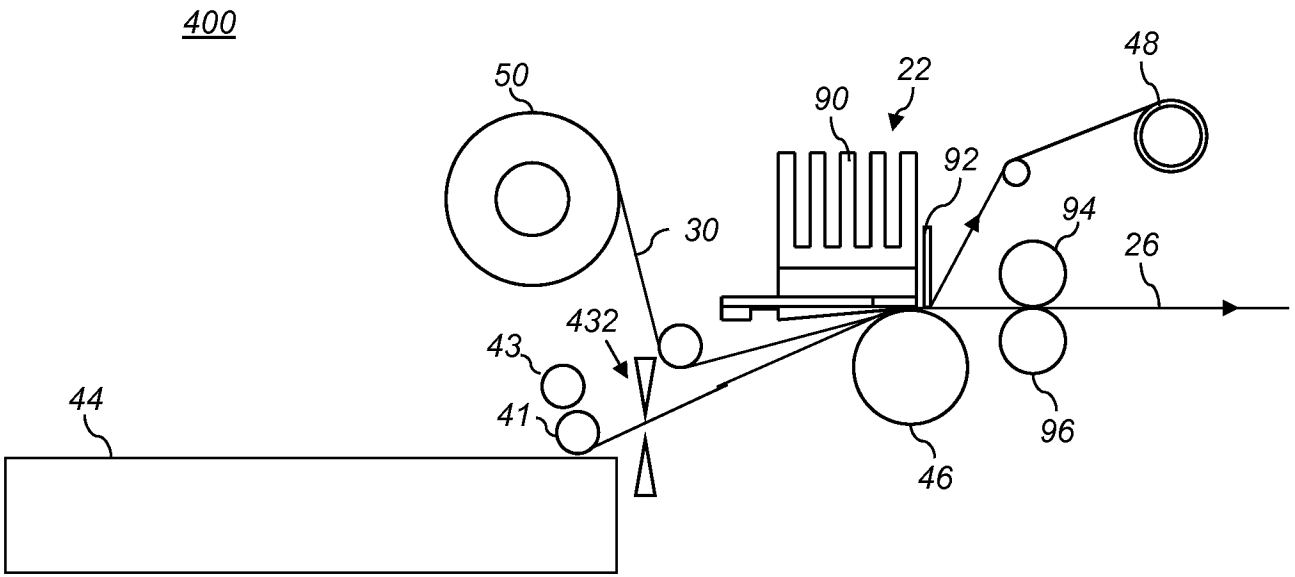
FIG. 4 is a diagram illustrating components of the thermal printing system shown in FIG. 1.
Figure 5:
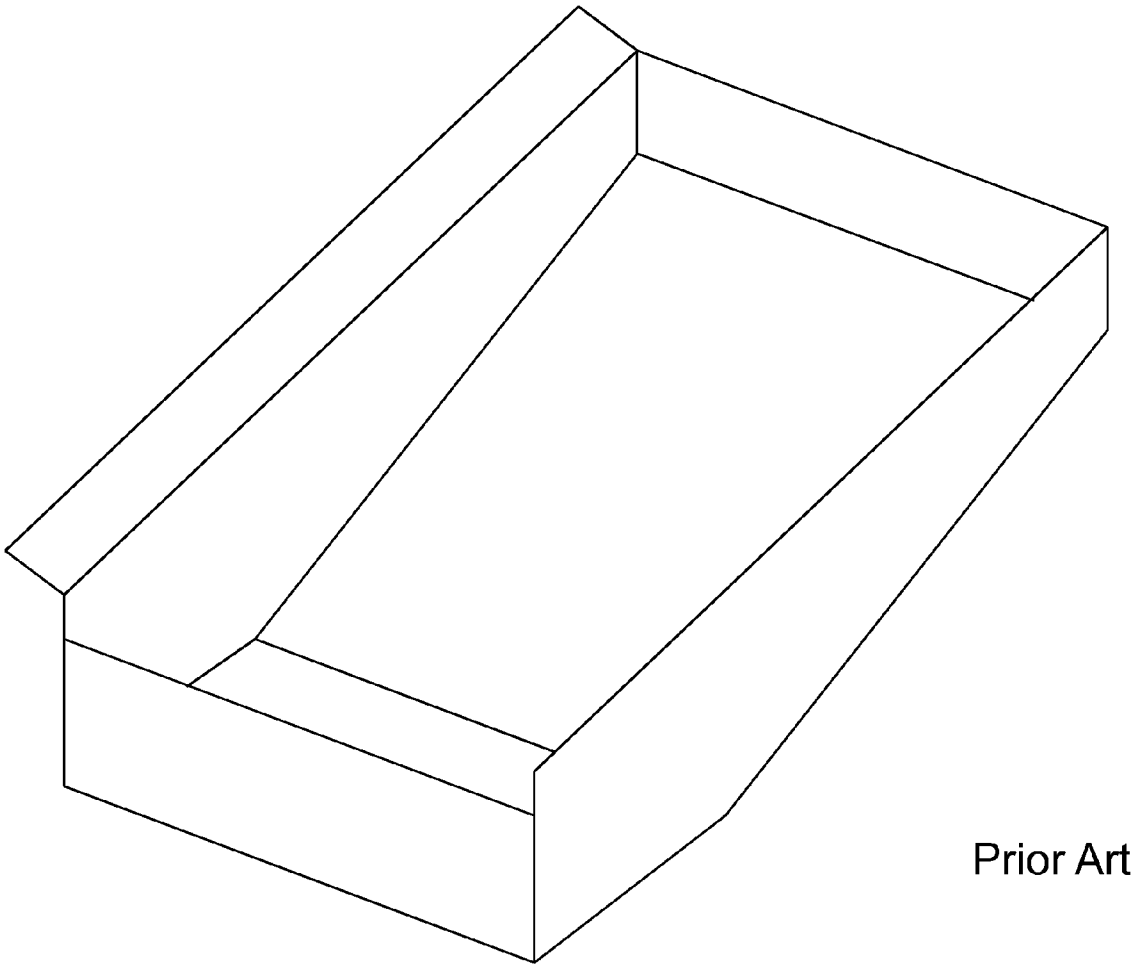
Prior Art Fig 5
FIG. 5 is a pictorial illustrating a receiver tray commonly known in the art.

FIG. 4 shows additional details for components of a thermal printing system 400 according to an aspect of the present invention. Donor ribbon supply roll 50 supplies donor ribbon 30, which is received by take-up roll 48. A receiver supply media cassette 44 supplies cut sheet receiver media 26. Receiver media 26 and donor ribbon 30 are merged together between platen roller 46 thermal print head 22, which includes a heat sink 90 and a peel member 92. Subsequent to the thermal print head 22 transferring donor material from the donor ribbon 30 to the receiver media 26, the peel member 92 separates the donor ribbon 30 from the receiver media 26. The donor ribbon 30 continues to travel on to the donor ribbon take-up roll 48, while the receiver media 26 travels between a pinch roller 94 and a capstan roller 96 that form a nip.

There are many applications where it is desirable to print images on both sides of the receiver media 26. For example, photo calendars and photo book pages generally have photographs or other content (e.g., text and graphics) printed on both sides of each page. To print duplex thermal prints, the receiver media 26 should have dye receiving layers coated on both sides of a substrate. Various arrangements can then be used to transfer dye onto both sides of the receiver media 26.

Figure 8:
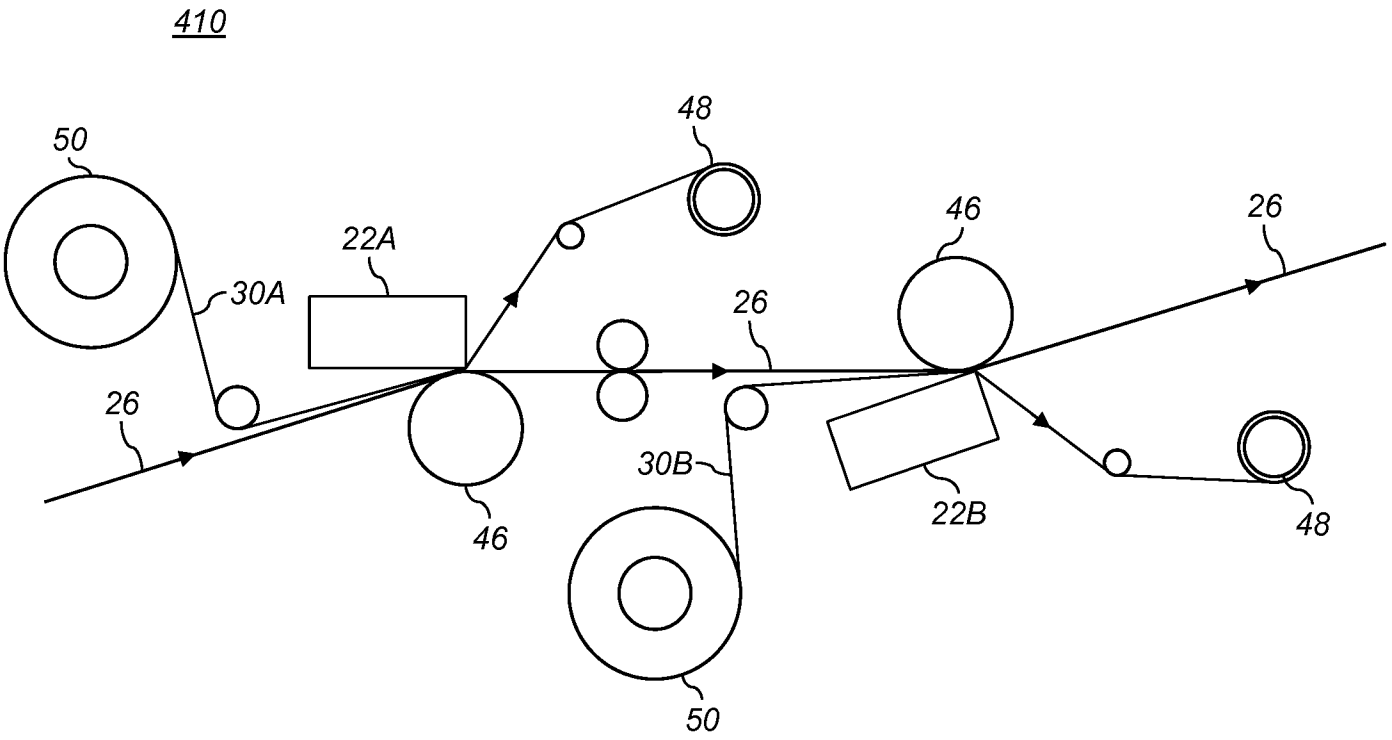
FIG. 8 is a diagram illustrating a duplex thermal printing system using two thermal printheads.

FIG. 8 shows one arrangement that can be used for a duplex thermal printing system 410. In this configuration, the main printing components shown in the arrangement of FIG. 4 are duplicated, with one being arranged to print on each side of the receiver media 26. A first thermal print head 22A transfers dye from a first donor ribbon 30A onto a first side of the receiver media 26, and a second thermal print head 22B transfers dye from a second donor ribbon 30B onto a second side of the receiver media 26. This configuration has the advantage that two-sided images can be printed without complex paper handling mechanism. The main disadvantage of this approach is that it adds significant cost to the printer since it doubles the number of thermal print heads 22A and 22B and other associated components. It also requires a longer media path, and therefore increases the printer size accordingly. Another disadvantage is that two rolls of donor ribbon 30A and 30B must be used, which means that the printer operator will need to stock larger numbers of rolls, and if the donor ribbons 30A and 30B are used at different rates they may need to service the printer more frequently to reload donor ribbon when one of the rolls is used up.

Figure 9:
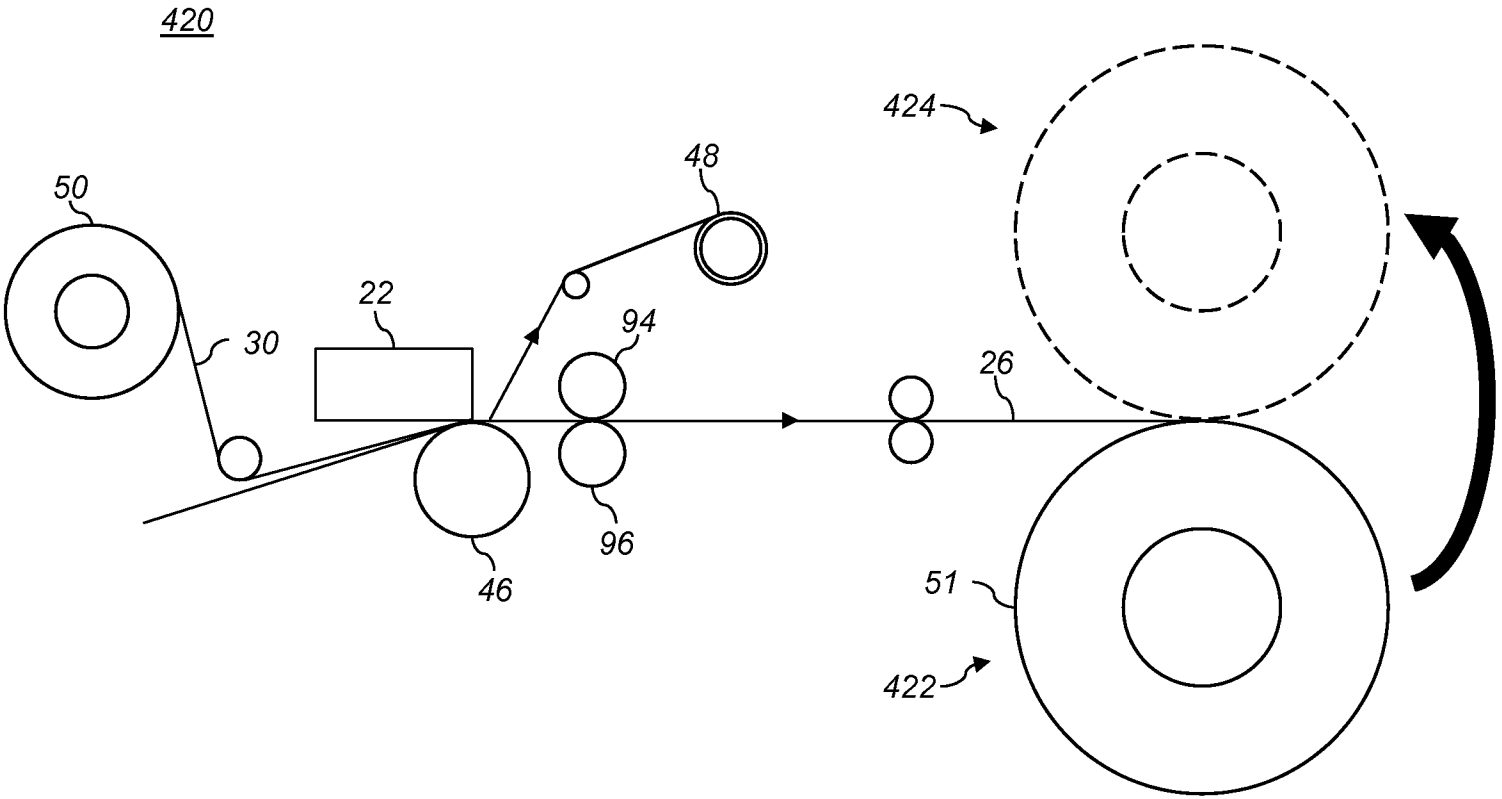
FIG. 9 is a diagram illustrating an alternate duplex thermal printing system that includes a turning mechanism for repositioning the receiver supply roll.

FIG. 9 shows another arrangement that can be used for a duplex thermal printing system 420. In this configuration, which is similar to that used in the KODAK D4000 Duplex Photo Printer, the receiver supply roll 51 is provided with a turning mechanism (not shown) that enables it to be pivoted from a first position 422 to a second position 424. After the first side of the image has been printed using the thermal print head, the receiver media 26 is wound back onto the receiver supply roll 51. The receiver supply roll 51 is then pivoted into the second position 424 and the receiver media 26 is rethreaded between the thermal print head 22 and the platen roller 46. The opposite side of the receiver media will now be facing the thermal print head 22 so that the second side of the image can be printed. The main disadvantage of this approach is that the turning mechanism for the receiver supply roll 51 adds significant cost to the printer. Since the receiver supply roll 51 is typically quite large relative to the size of the printer, the printer size must also be increased to provide space to position the receiver supply roll 51 into the second position 424.

Figure 10:
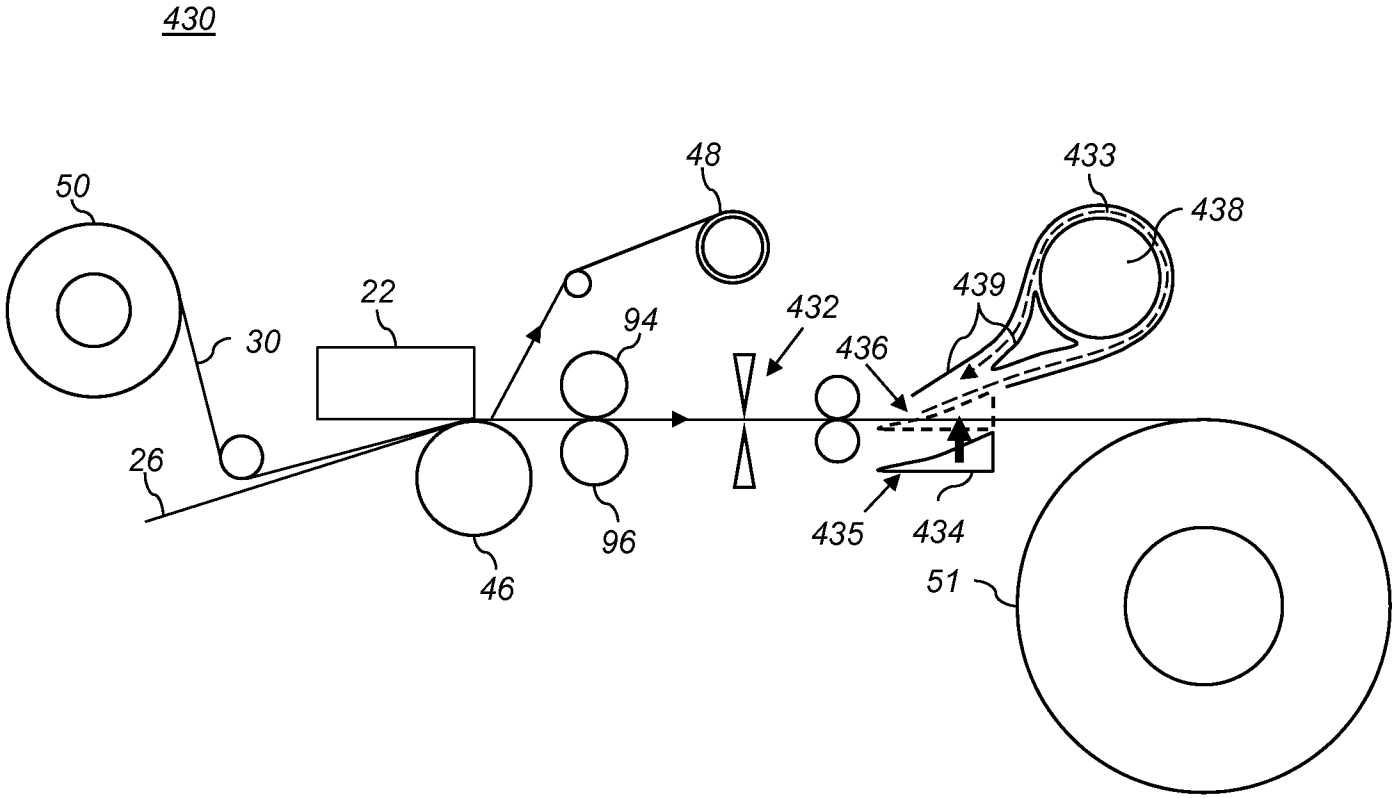
FIG. 10 is a diagram illustrating an alternate duplex thermal printing system using a turn roller.

FIG. 10 shows a duplex thermal printing system 430 that includes a turning mechanism for turning over the receiver media 26. In this configuration a cutter 432 is provided that can be used to cut the receiver media 26. The cutter 432 can be adjusted to cut the receiver media into various sizes. Some of the cut receiver media may correspond to printed images and some of the cut receiver media may be waste.

Figure 6:
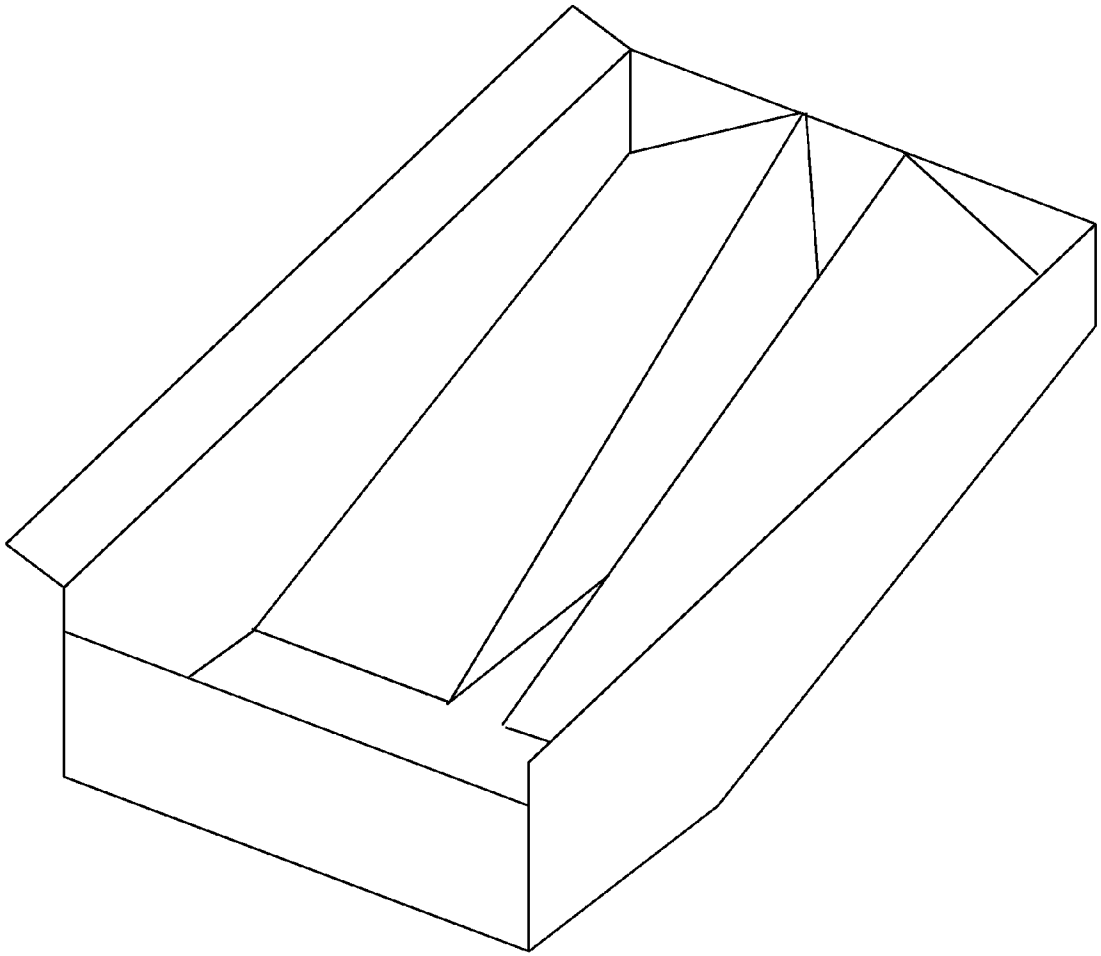
FIG. 6 is a pictorial illustrating a receiver tray with angled surfaces for print guidance and center waste area according to an aspect of the present invention.
Figure 6A:
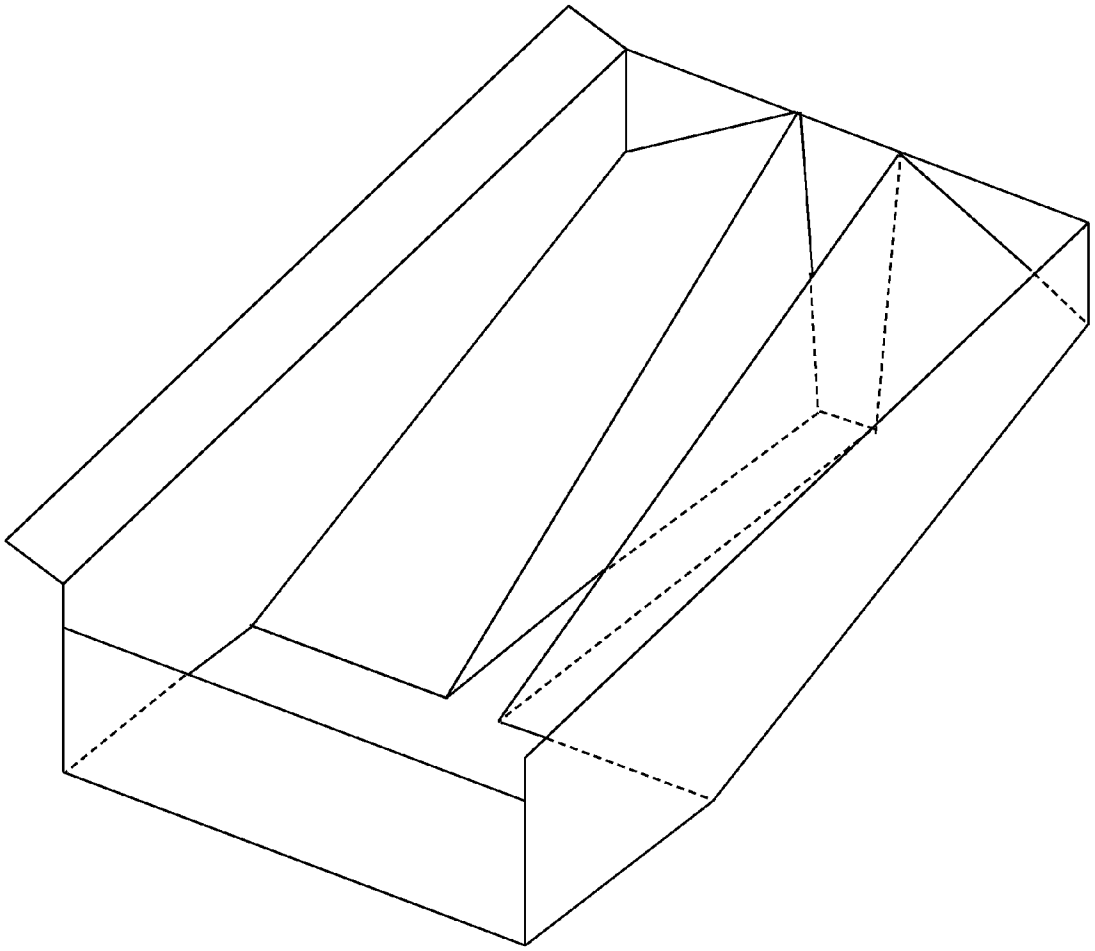
FIG. 6A is a pictorial of the tray of FIG. 6 with the hidden edges shown using dashed lines.

As shown in FIGS. 6 and 6A, the receiver tray 44 includes a cut sheet receiving well comprising at least two side walls, two angled surfaces, and a waste area disposed between the first and second angled surfaces. The cut receiver media with printed images is received onto the angled surfaces from the thermal printer. As noted above, an 8.5 inch-wide roll fed media can be used to print two 4×6 inch images in portrait mode with a 0.5 inch center waste strip. This waste strip is received into the waste area and is automatically separated from the printed receiver media. Separation of the waste strip from the printed media is enhanced by the angle of the angled surfaces, also referred to herein as ramps. As shows in FIGS. 6, 6A, 7, and 7A, the ramps can be slanted towards their respective adjacent sidewalls. This slant causes gravity to pull the two printed receiver media away from the waste strip, thus aiding in separating the waste strip.

Figure 7:
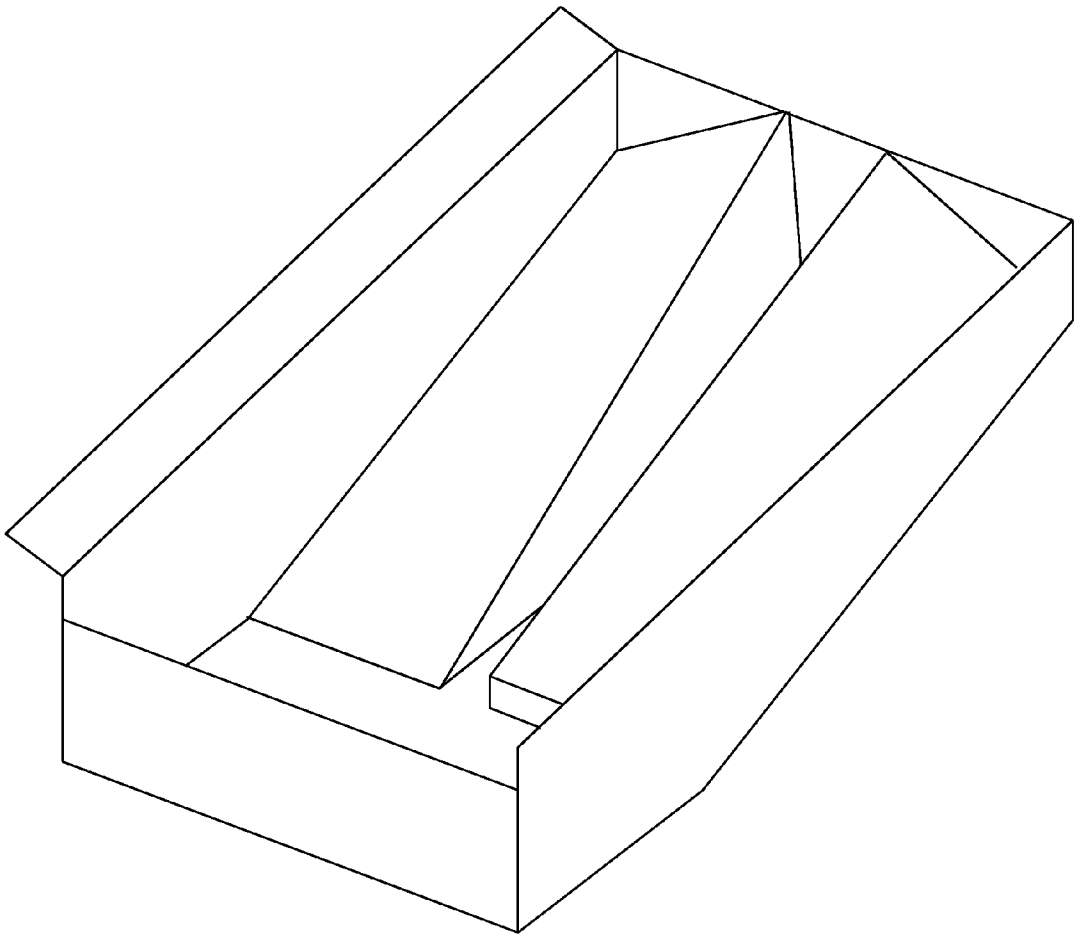
FIG. 7 is a pictorial illustrating a receiver tray with angled surfaces for print guidance and center waste area according to another aspect of the present invention.
Figure 7A:
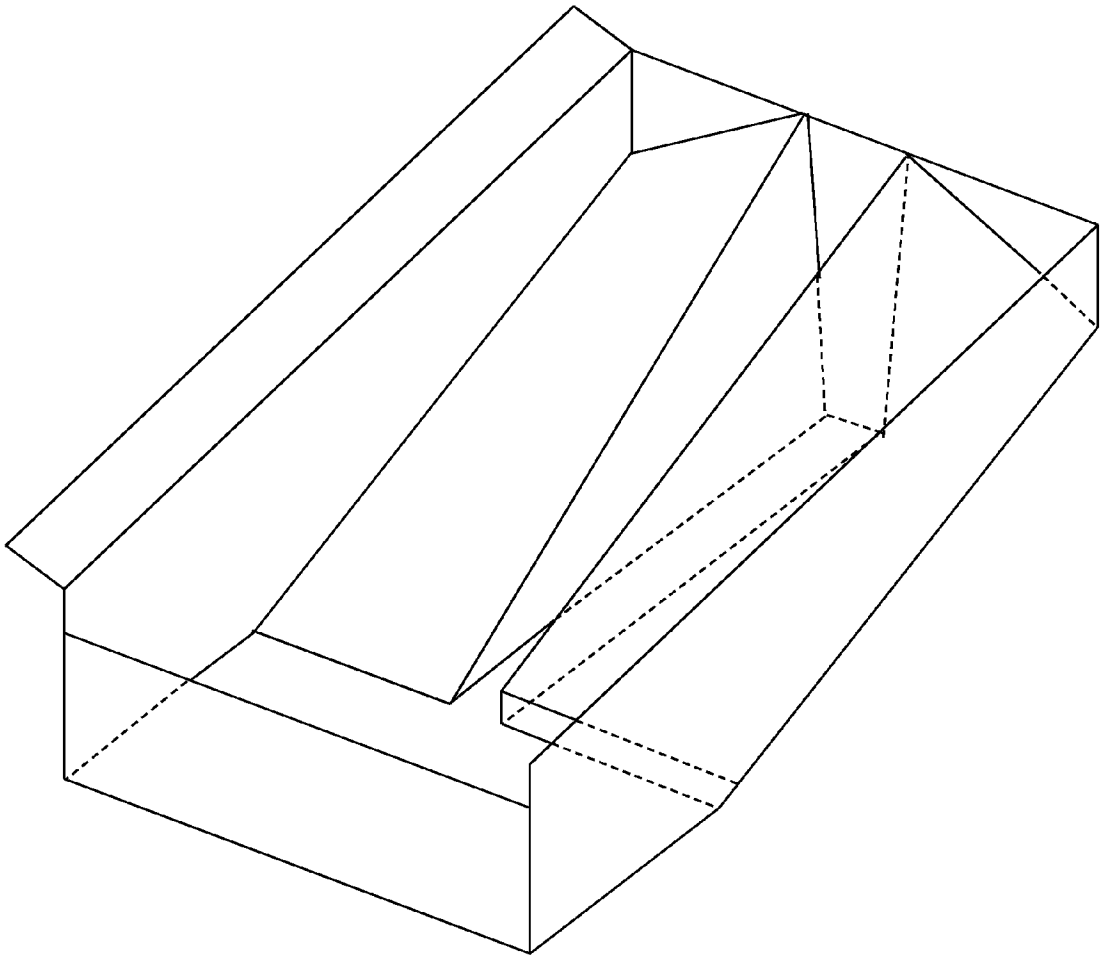
FIG. 7A is a pictorial of the tray of FIG. 6 with the hidden edges shown using dashed lines.

FIGS. 7 and 7A show another aspect of the present invention where the bottom edge of one of the angled surfaces is higher than the bottom edge of the other angled surface. This difference is height in the edges allows for the media received on the two angled surfaces to be interleaved in a manner that retains the order of the print sequence. Specifically, because the angled surface with the higher bottom edge has a lower slope than the other angled surface, the printed receiver media deposited onto the angled surface with the higher bottom edge reaches the base of the receiver tray shortly after the printed receiver media deposited onto the angled surface with the lower bottom edge. Although the receiver tray depicted in FIGS. 6, 6A, 7, and 7A has a rectangular shape, the receiver tray can have a trapezoidal or triangular shape in order to further facilitate interleaving or collating of the printed receiver media. When the receiver tray is rectangular, the result of using the receiver tray is two separate stacks of printed receiver media. However, when the receiver tray has a trapezoidal or triangular shape in which the width of the receiver tray at the high end of the ramps is greater than the width of the receiver tray at the low end of the ramps, the result of using the receiver tray is a single interleaved, or collated, stack of printed receiver media. When a trapezoidal or triangular receiver tray is used and the bottom edge of one of the angled surfaces is higher than the bottom edge of the other angled surface, the printed receiver media can be printed such that the resulting collated stack is in a known, predetermined order.

Further, although the waste area of FIGS. 6 and 7 is shown in the center, it is obvious to one skilled in the art that arrangements of the angled surfaces can permit the waste area to be offset towards one of the side walls to allow prints of differing sizes to be received on each of the two angled surfaces. In other embodiments, the waste area can be positioned directly adjacent to one of the sidewalls, or two waste areas can be provided, one adjacent to each sidewall. These waste areas can be provided in addition to a central waste area, or can be provided without the central waste area. Positioning the waste areas in this manner allows for trapping waste paper when the edges of the receiver media are trimmed. In another aspect of the present invention, the width of the angled ramps can be adjusted to move the waste area to a desired location in the receiver tray based on the sizes of the cut receiver media with printed images. In yet another aspect of the present invention, there may only be one angled ramp to receive cut printed receiver media with the waste area located adjacent to one of the side walls.

The invention has been described in detail with particular reference to certain preferred embodiments thereof, but it will be understood that variations and modifications can be effected within the spirit and scope of the invention.

The invention claimed is:

1. A receiver supply tray adapted to receive cut receiver media, comprising:

a cut sheet receiving well having at least two side walls;

a first ramp disposed between the two side walls, wherein the first ramp is adjacent to one of the side walls and wherein, at its lowest point, an upper surface of the first ramp is elevated above a bottom surface of the cut sheet receiving well;

a second ramp positioned adjacent to a side wall that is opposite to the side wall to which the first ramp is adjacent and wherein, at its lowest point, an upper surface of the second ramp contacts a bottom surface of the cut sheet receiving well; and a waste area between the first ramp and a non-adjacent side wall, the waste area adapted to receive waste cut receiver media and the first ramp adapted to receive printed cut receiver media.

2. The receiver supply tray according to claim 1, wherein the waste area is located adjacent to the first ramp.

3. The receiver supply tray according to claim 1, wherein the cut sheet receiving well has a proximal end, a distal end, and a bottom surface.

4. The receiver supply tray according to claim 3, wherein the first ramp has an upper surface, and wherein the upper surface of the first ramp has a higher elevation relative to the bottom surface of the cut sheet receiving well at the proximal end of the cut sheet receiving well than at the distal end of the cut sheet receiving well.

5. The receiver supply tray according to claim 1, wherein the waste area is located between the first ramp and the second ramp.

6. The receiver supply tray according to claim 1, wherein the cut sheet receiving well has a trapezoidal shape.

* * * * *